US009787036B2

(12) United States Patent
Kiryu et al.

(10) Patent No.: US 9,787,036 B2
(45) Date of Patent: Oct. 10, 2017

(54) CONNECTOR INCLUDING A SWITCH AND A LOCKING MECHANISM FOR LOCKING A BUTTON FOR CLOSING THE SWITCH

(71) Applicant: FUJITSU COMPONENT LIMITED, Tokyo (JP)

(72) Inventors: Koichi Kiryu, Nagano (JP); Mitsuru Kobayashi, Tokyo (JP); Koki Sato, Tokyo (JP); Masatoshi Noritake, Tokyo (JP); Keiichi Hirose, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 0 days.

(21) Appl. No.: 15/407,599

(22) Filed: Jan. 17, 2017

(65) Prior Publication Data

US 2017/0214189 A1 Jul. 27, 2017

(30) Foreign Application Priority Data

Jan. 22, 2016 (JP) ..... 2016-011048

(51) Int. Cl.
*H01R 29/00* (2006.01)
*H01R 13/703* (2006.01)

(52) U.S. Cl.
CPC ..... *H01R 13/7036* (2013.01)

(58) Field of Classification Search
CPC ..... H01R 2103/00; H01R 12/585; H01R 13/6616; H01R 13/68; H01R 31/52; H01H 9/104; H01H 9/22; H01H 1/403; H01H 1/42; H01H 9/02; H01H 13/023; H01H 1/52; H01H 13/20; H01H 15/10
USPC ..... 439/188, 620.2, 620.21, 620.3, 652; 200/50.01, 50.09, 50.11, 50.12, 252, 255, 200/293, 314, 325, 520, 547
See application file for complete search history.

(56) References Cited

U.S. PATENT DOCUMENTS 3,604,875 A * 9/1971 Walters ..... H01H 71/205 200/430
5,270,505 A * 12/1993 Magiera ..... H01H 3/36 200/331

(Continued)

FOREIGN PATENT DOCUMENTS

| | | |
|---|---|---|
| JP | H05-082208 | 4/1993 |
| JP | 2003-031301 | 1/2003 |
| JP | 2012-104448 | 5/2012 |

*Primary Examiner* — Thanh Tam Le
(74) *Attorney, Agent, or Firm* — IPUSA, PLLC

(57) ABSTRACT

A connector includes a switch, a button configured to move a card of the switch, a spring connected to the button, and a connection terminal connected to the switch. When another connector is inserted into the connector, the connection terminal contacts a connection terminal of the other connector, and when the other connector is further inserted, the button is pressed by the other connector to move the card to close the switch to allow electric power to be supplied from the connector to the other connector, and the spring has its locking part engaging with an engaging part of the housing of the connector. When the other connector is pulled off of the connector, the spring has its locking part disengaging from the engaging part to open the switch, with the connection terminals contacting each other, to interrupt the supply of electric power.

6 Claims, 13 Drawing Sheets

(56) References Cited

U.S. PATENT DOCUMENTS

| | | | | |
|---|---|---|---|---|
| 5,648,646 | A * | 7/1997 | Flegel | H01H 9/26 200/50.32 |
| 6,841,744 | B1 * | 1/2005 | Kodo | H01H 15/02 200/16 C |
| 7,211,758 | B2 * | 5/2007 | Lui | H01H 1/20 200/341 |
| 7,942,684 | B1 * | 5/2011 | Beak | H01R 13/639 200/51.12 |
| 8,692,634 | B2 * | 4/2014 | Yuba | H01H 15/02 200/51.09 |
| 8,841,572 | B2 * | 9/2014 | Iwamoto | H01H 1/26 200/430 |
| 8,864,553 | B2 * | 10/2014 | Vigano | B24C 5/04 451/102 |
| 8,878,091 | B2 * | 11/2014 | Yuba | H01H 9/42 218/36 |
| 9,004,924 | B2 * | 4/2015 | Kuo | H01R 13/6205 439/188 |
| 9,225,125 | B2 * | 12/2015 | Iwamoto | H01R 13/70 |
| 9,281,635 | B2 * | 3/2016 | Beak | H01R 13/7132 |

* cited by examiner

CONNECTOR INCLUDING A SWITCH AND A LOCKING MECHANISM FOR LOCKING A BUTTON FOR CLOSING THE SWITCH

CROSS-REFERENCE TO RELATED APPLICATION

The present application is based upon and claims the benefit of priority of Japanese Patent Application No. 2016-011048, filed on Jan. 22, 2016, the entire contents of which are incorporated herein by reference.

BACKGROUND OF THE INVENTION

1. Field of the Invention

The present invention relates to connectors and connector assemblies.

2. Description of the Related Art

In general, electric apparatuses operate with electric power supplied from a power supply through a connector. Such a connector includes a male (inserting) connector and a female (receiving) connector, which are mated to each other to establish an electrical connection as described in, for example, Japanese Laid-Open Patent Application No. 5-82208 and Japanese Laid-Open Patent No. 2003-31301.

In recent years, studies have been made, as a measure against global warming, of supplying direct-current (DC), high-voltage electric power in power transmission in local areas as well. Such a form of power supply, which is reduced in power loss in voltage conversion or power transmission and does not require an increase in cable thickness, is considered desirable particularly for information apparatuses such as servers, which consume a large amount of power.

When using such high-voltage electric power for information apparatuses such as servers, a connector different from connectors used for normal alternating-current (AC) commercial power supplies is used to establish an electrical connection because the apparatuses are installed and maintained by manual work.

For related art, reference may also be made to Japanese Laid-Open Patent Application No. 2012-104448.

SUMMARY OF THE INVENTION

According to an aspect of the present invention, a connector includes a switch, a button configured to move a card of the switch, a spring connected to the button, and a connection terminal connected to the switch. When another connector is inserted into the connector, the connection terminal contacts a connection terminal of the other connector, and when the other connector is further inserted, the button is pressed by the other connector to move the card to close the switch to allow electric power to be supplied from the connector to the other connector, and the spring has its lacking part engaging with an engaging part of the housing of the connector. When the other connector is pulled off of the connector, the spring has its locking part disengaging from the engaging part to open the switch, with the connection terminals contacting each other, to interrupt the supply of electric power.

DESCRIPTION OF THE EMBODIMENTS

Figure 1:
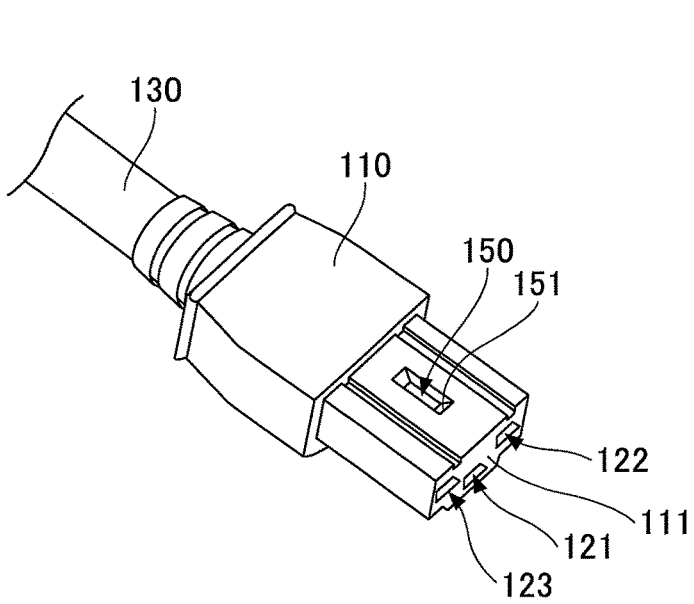
FIG. 1 is a perspective view of a jack connector used in an embodiment.

According to connectors incorporating a switch, the switch currently used is not usable as it is when the voltage supplied from a power supply is more than or equal to 100 V or is a high-voltage direct current. For example, when the electric power supplied from a power supply is 400 V DC, it is dangerous to use a switch currently used for 100 V AC as it is because sufficient safety and reliability are not ensured.

According to an aspect of the present invention, a connector assembly capable of safely supplying high-voltage electric power is provided.

According to an aspect of the present invention, a connector that supports DC power supplies or power supplies higher in voltage than current commercial power supplies and is capable of safely supplying electric power from these power supplies is provided.

One or more embodiments of the present invention are described below with reference to the accompanying drawings. In the following description, the same element or member is referred to using the same reference numeral, and is not repetitively described.

Figure 2:
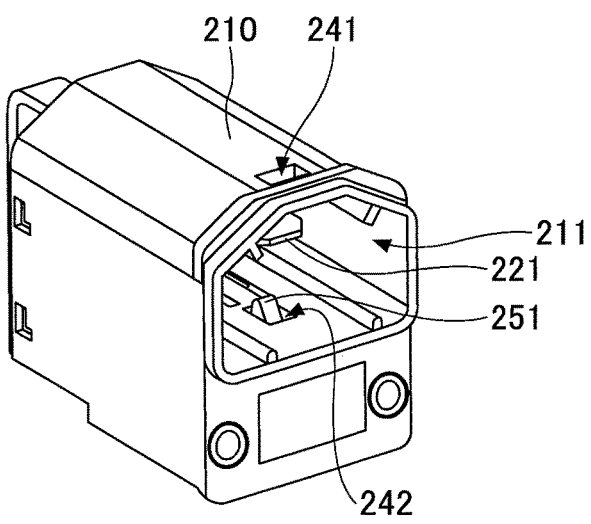
FIG. 2 is a perspective view of a plug connector according to the embodiment.
Figure 3:
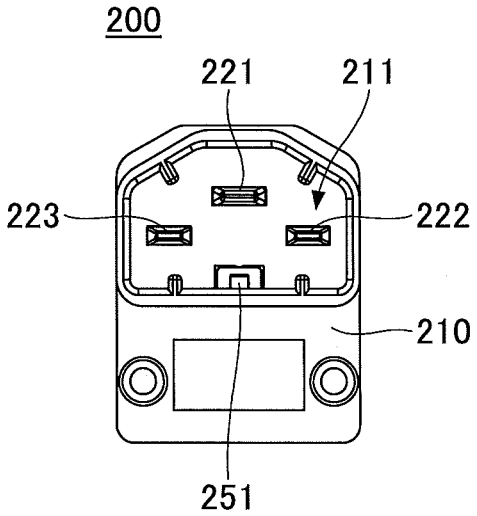
FIG. 3 is a front view of the plug connector according to the embodiment.

A structure of a connector according to an embodiment is described below. A connector of this embodiment is a plug connector configured to connect to another complementary connector, which is a jack connector as depicted in FIG. 1. FIG. 1 is a perspective view of a jack connector 100 used in this embodiment. FIGS. 2 and 3 are a perspective view and a front view, respectively, of a plug connector 200 according to this embodiment, illustrating a structure of the plug connector 200. In the following description, the jack connector 100 and the plug connector 200 may be described in combination as a connector or a connector assembly.

First, the jack connector 100 is described with reference to FIG. 1. The jack connector 100 includes a jack housing 110. The jack housing 110 includes a contact surface 111 formed at a first end, which is a leading end in a direction in which the jack housing 110 is inserted into the plug connector 200. Jack openings 121, 122 and 123 into which plug terminals 221, 222 and 223 of the plug connector 200 are to be inserted, respectively, are provided through the contact surface 111. Jack terminals to connect to the plug terminals 221, 222 and 223 are provided behind the jack openings 121, 122 and 123. A power supply cable 130 for supplying electric power is connected to a second end of the jack housing 110 opposite to the first end. As depicted in, for example, FIG. 11, the jack connector 100 includes a projection 141 for keeping the jack connector 100 mated to the plug connector 200 and a depressing part 142 for vertically moving the position of the projection 141. According to this embodiment, the jack housing 110 further includes an unlocking groove 150 to serve as an unlocking part for placing the plug connector 200 in a non-conducting state. Part of the unlocking groove 150 on its contact surface 111 side is sloped to form a slope 151.

Next, the plug connector 200 is described. Referring to FIGS. 2 and 3, the plug connector 200 includes a plug housing 210. The plug terminals 221, 222 and 223 are provided in a plug connector opening 211 of the plug housing 210. The plug terminals 221, 222 and 223 connect to the jack terminals through the jack openings 121, 122 and 123 of the jack connector 100. That is, the plug terminal 221 connects to the jack terminal through the jack opening 121, the plug terminal 222 connects to the jack terminal through the jack opening 122, and the plug terminal 223 connects to the jack terminal through the jack opening 123. According to this embodiment, the plug terminal 221 is a ground (GND) terminal, and is longer than the plug terminals 222 and 223. The jack connector 100 connects to the plug connector 200 in the position as depicted in FIG. 2 with the upper surface of the jack connector 100 in FIG. 1 facing downward.

Figure 9:
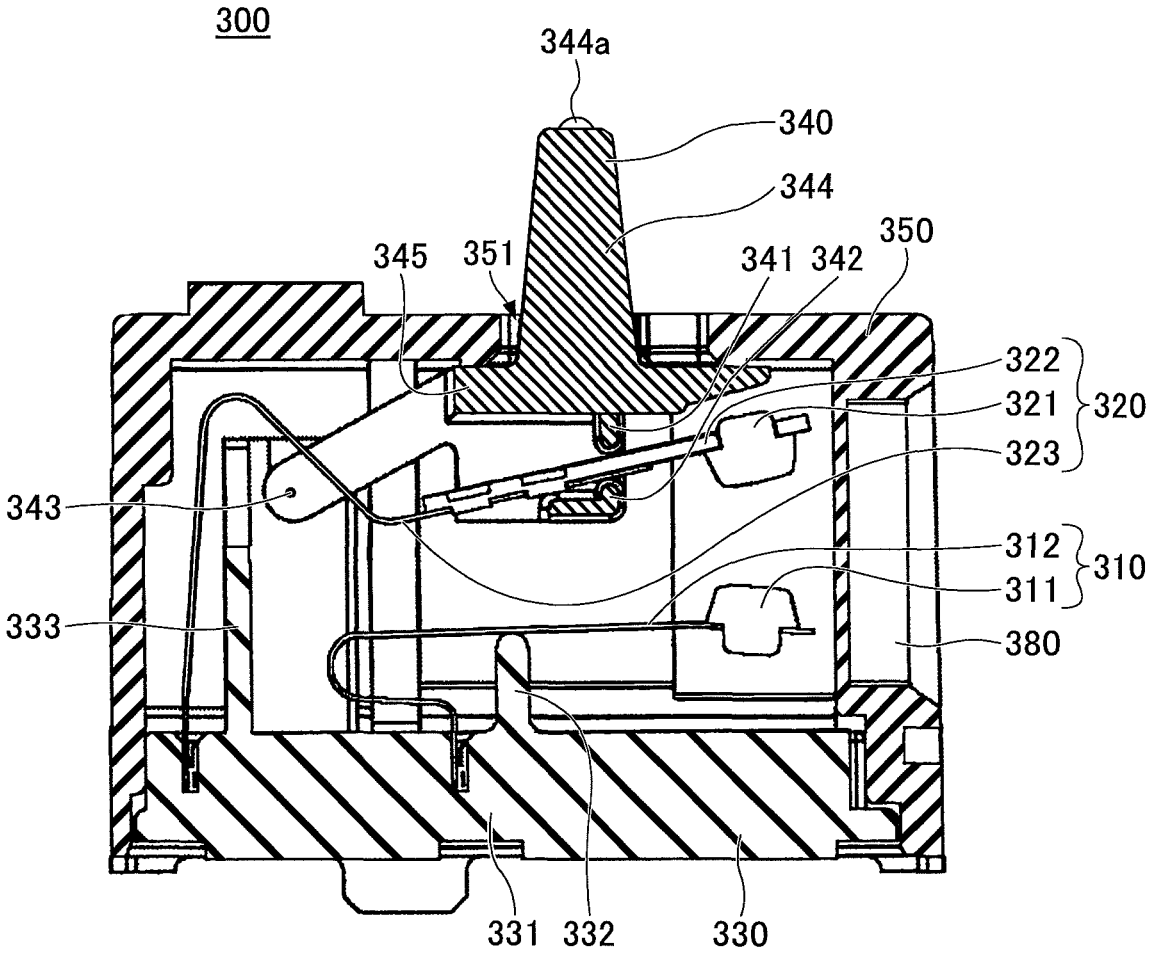
FIG. 9 is a diagram illustrating a structure of a switch in the OFF state.

The plug connector 200 includes a switch 300 as depicted in, for example, FIG. 9 in the plug housing 210. Each of the plug terminals 222 and 223 is electrically connected to one of movable parts 320 of the switch 300. Electric power starts to be supplied when the switch 300 is turned on with the jack connector 100 and the plug connector 200 being mated to each other to connect the plug terminals 222 and 223 to jack terminals through the jack openings 122 and 123, respectively.

Figure 4:
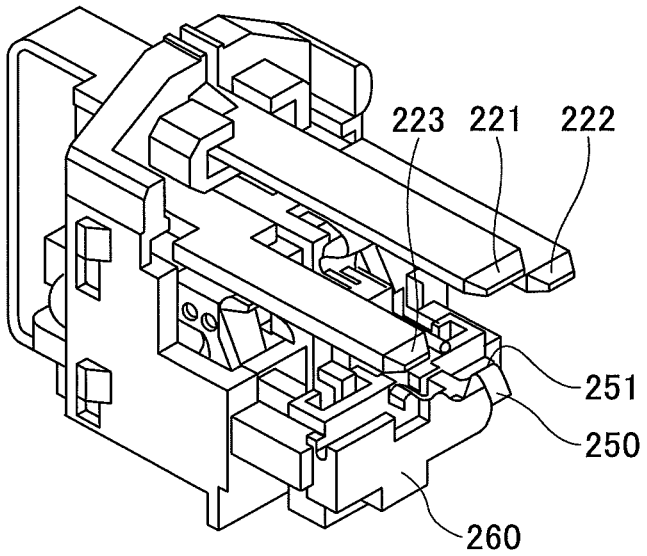
FIG. 4 is a diagram illustrating the plug connector according to the embodiment.
Figure 5:
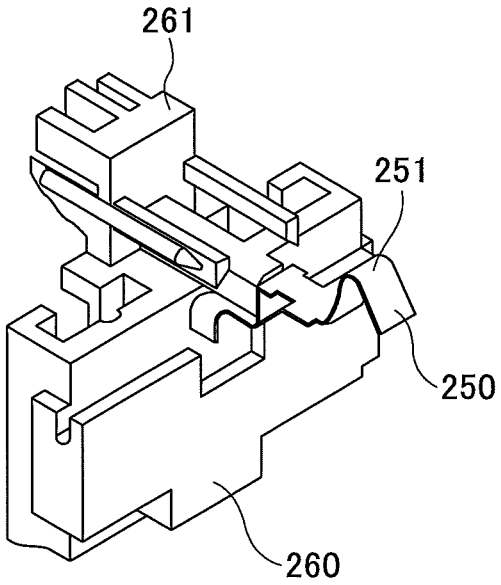
FIG. 5 is a diagram illustrating the plug connector according to the embodiment.
Figure 6:
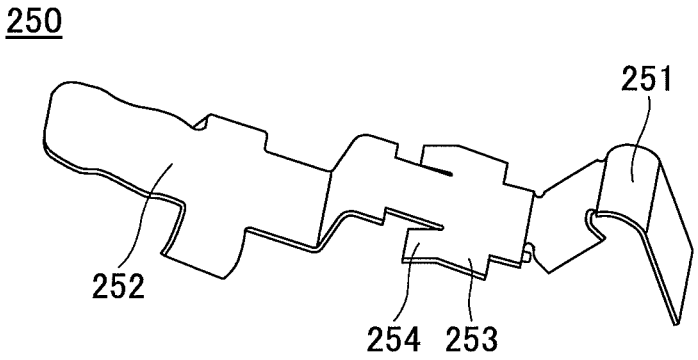
FIG. 6 is a perspective view of an unlocking spring according to the embodiment.

Referring to FIGS. 4 and 5, the plug connector 200 includes an unlocking spring 250 and a button 260 for turning on and off the switch 300. The button 260 includes a contact movable part 261. The contact movable part 261 is pressed by the contact surface 111, which is positioned at an end of the jack connector 100 to be inserted into the plug connector 200, to move toward the inside of the plug connector 200. FIG. 4 is a perspective view of the plug connector 200 from which the plug housing 210 is removed. FIG. 5 is a perspective view of the unlocking spring 250 and the button 260 connected to each other. The unlocking spring 250 is formed by bending an elastic metal plate, and includes a projection 251, a connecting part 252, a locking part 253, and a slope 254 as depicted in FIG. 6. The locking part 253 and the slope 254 are formed between the projection 251 and the connecting part 252. The button 260 and the unlocking spring 250 are connected at the connecting part 252. The unlocking spring 250 moves as the button 260 moves, and the button 260 moves as the unlocking spring 250 moves.

Figure 7:
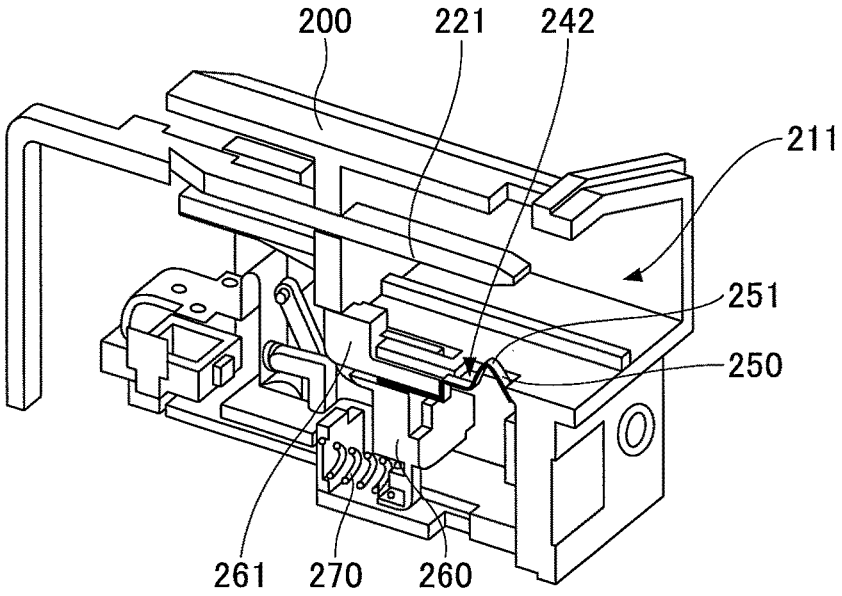
FIG. 7 is a diagram illustrating the plug connector according to the embodiment.
Figure 8:
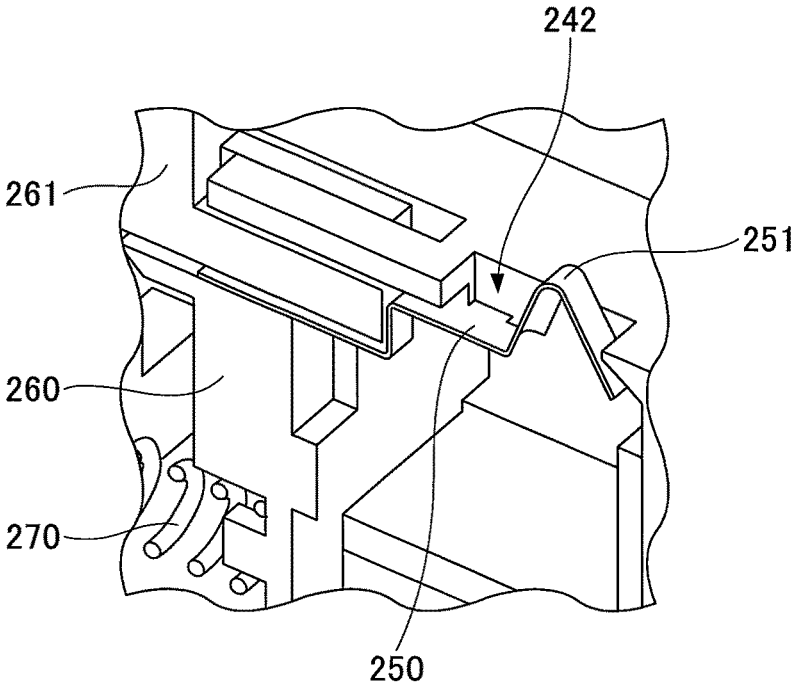
FIG. 8 is an enlarged view of part of the plug connector depicted in FIG. 7.

Referring to FIGS. 2, 7 and 8, a spring opening 242 is provided through an interior wall of the plug housing 210 that faces the plug connector opening 211. The projection 251 of the unlocking spring 250 projects into the plug connector opening 211 through the spring opening 242. Furthermore, the plug connector 200 includes a return spring 270 that returns the button 260 when the switch 300 is turned off. The return spring 270 is formed of a coil spring, and is so provided as to exert a restoring force in a direction to push back the button 260 to the front side of the plug connector 200 on which side the entrance of the plug connector opening 211 is located. FIG. 7 is a perspective cross-sectional view of the plug connector 200. FIG. 8 is an enlarged view of part of the plug connector 200 depicted in FIG. 7.

Furthermore, as depicted in FIG. 2, an opening 241 is formed in the plug housing 210. The projection 141 of the jack connector 100 enters the opening 241. The depressing part 142 is depressed to move the projection 141 downward. When the switch 300 is closed with the jack connector 100 and the plug connector 200 being fitted to each other, the projection 141 enters the opening 241 to engage with the opening 241. Therefore, the jack connector 100 is prevented from being pulled off of the plug connector 200 while the electrical connection is established between the jack connector 100 and the plug connector 200.

To detach the jack connector 100 from the plug connector 200, the depressing part 142 of the jack connector 100 is pressed to move the projection 141 to a position lower than the opening 241 of the plug connector 200 to disengage the projection 141 from the opening 241 and separate the plug connector 200 and the jack connector 100.

Figure 10:
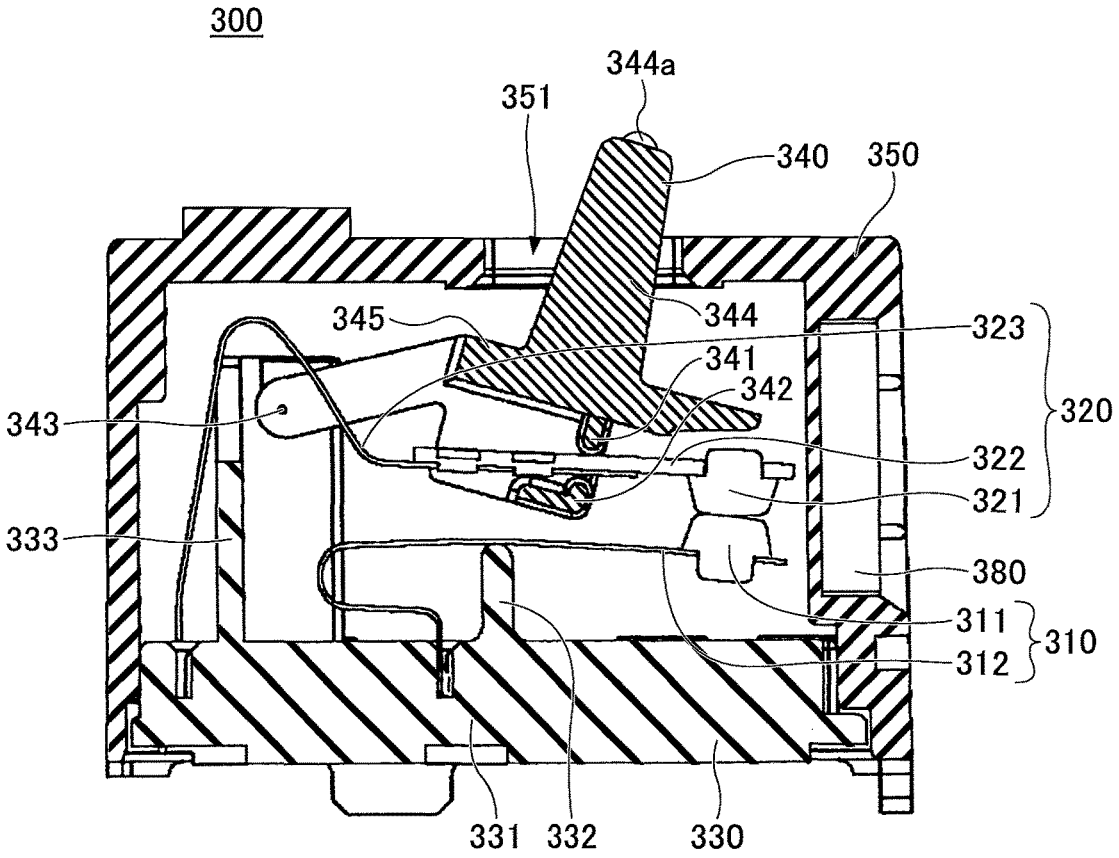
FIG. 10 is a diagram illustrating the structure of the switch in the ON state.

Next, the switch 300 provided in the plug connector 200 is described. The switch 300, which is a switch for controlling the supply of electric power, is also referred to as "power switch." FIGS. 9 and 10 are diagrams depicting an internal structure of the switch 300 in the OFF state and the ON state, respectively.

The switch 300 includes two contact pairs of a fixed part 310 including a fixed contact 311 and the movable part 320 including a movable contact 321. The contact pairs are provided one for each of the plug terminals 222 and 223. FIGS. 9 and 10 depict one of the contact pairs of the fixed part 310 and the movable part 320. The switch 300 performs on/off control of the supply of electric power based on the presence or absence of the contact of the fixed contact 311 and the movable contact 321 of each contact pair. The following description is given, taking one of the contact pairs as an example.

The fixed part 310 is formed of an electrically conductive material such as metal in its entirety. The fixed part 310 further includes a fixed spring 312. The fixed contact 311 is provided at a first end of the fixed spring 312, and contacts the movable contact 321 of the movable part 320. The fixed spring 312 is formed by bending, for example, a metal plate formed of a material such as copper or an alloy containing copper. The fixed contact 311 is formed of an alloy of silver and copper. A second end of the fixed spring 312 is fixed to a base block body 331 of a base block 330 with an intermediate portion of the fixed spring 312 being supported by a fixed part support 332 of the base block 330.

The movable part 320 is formed of an electrically conductive material such as metal in its entirety. The movable part 320 further includes a movable plate 322 and a movable spring 323. The movable contact 321 is provided at a first end of the movable plate 322, and contacts the fixed contact 311. A second end of the movable plate 322 connects to a first end of the movable spring 323. Each of the movable plate 322 and the movable spring 323 is formed by bending, for example, a metal plate formed of a material such as copper or an alloy containing copper. The movable contact 321 is formed of an alloy of silver and copper. A second end of the movable spring 323 is fixed to the base block body 331. Because the movable spring 323 is formed by bending, for example, a metal plate, the movable spring 323 is flexible to allow the movable contact 321 provided at the first end of the movable plate 322 to move upward and downward in FIGS. 9 and 10. An insulation wall 333 formed of, for example, a flame-retardant resin is provided on the base block 330 between a portion to which the second end of the fixed spring 312 is connected and a portion to which the second end of the movable spring 323 is connected. The movable spring 323 extends from the base block 330 to bend around part of the insulation wall 333.

The switch 300 includes a card 340 pivotable about a shaft 343 to move the movable plate 322. The card 340 is common to the contact pairs. Alternatively, multiple cards 340 may be provided one for each contact pair. An upper surface of the movable part 320, which serves as a first surface of the movable plate 322, is in contact with an upper contacting part 341 that serves as a first contact of the card 340. A lower surface of the movable part 320, which serves as a second surface of the movable plate 322, is in contact with a lower contacting part 342 that serves as a second contact of the card 340. When the card 340 is pivoted about the shaft 343 in this state, a force is applied to the movable plate 322 in contact with the upper contacting part 341 or the lower contacting part 342 to allow the movable contact 321 to move upward or downward. The upper contacting part 341 and the lower contacting part 342 slide on the movable plate 322. Therefore, to reduce frictional resistance, a surface layer formed of, for example, fluororesin may be provided at a surface of the upper contacting part 341 and a surface of the lower contacting part 342.

The fixed part 310 and the movable part 320 are provided in a region surrounded by the base block 330 and a switch part case 350 (hereinafter, "surrounded region"). The card 340 includes a projection 344 and a card body 345. The projection 344 projects outward through a switch part opening 351 provided in the switch part case 350. The card body 345 is positioned in the surrounded region. Accordingly, in the switch 300, the upper contacting part 341 and the lower contacting part 342 are provided in the surrounded region. The card 340, the base block 330, and the switch part case 350 are formed of an insulating material such as a resin.

Although not depicted in FIGS. 9 and 10, the button 260 as depicted in, for example, FIG. 4, which is depressed to pivot the card 340 about the shaft 343, is provided outside the switch part case 350. The card 340 includes a contact 344*a* provided at the top of the projection 344. The contact 344*a* contacts an inner wall of the button 260.

The operation of turning on and off the switch 300 is described. In the case of turning on the switch 300, the jack connector 100 is inserted into the plug connector opening 211 of the plug connector 200 to press the button 260. As a result, the card 340 contacting the button 260 pivots about the shaft 343 to apply a force to the movable plate 322 through the upper contacting part 341 in the downward direction of FIG. 9, so that the movable contact 321 and the fixed contact 311 come into contact as depicted in FIG. 10. As a result, electric power is supplied from a power supply through the movable contact 321 and the fixed contact 311.

In the case of turning off the switch 300, the plug connector 200 and the jack connector 100 are separated, so that the restoring force of the return spring 270 returns the button 260 to its original position as described below. As a result, the card 340 contacting the button 260 pivots about the shaft 343 in the upward direction of FIG. 10 to apply an upward force to the movable plate 322 through the lower contacting part 342. Thus, the movable contact 321 and the fixed contact 311 can be separated from each other with the upward force applied to the movable plate 322 to stop the supply of electric power from the power supply as depicted in FIG. 9. At this point, an arc may be generated between the movable contact 321 and the fixed contact 311. Therefore, a permanent magnet 380 generating a magnetic field in a direction substantially perpendicular to a direction in which an arc is generated is provided near the contact position of the movable contact 321 and the fixed contact 311 to make it possible to blow off the arc by the force of the magnetic field. The permanent magnet 380 is common to the contact pairs. Alternatively, multiple permanent magnets 380 may be provided one for each contact pair.

As described above, the insulation wall 333 is provided in the switch 300. Therefore, even if the melting or the like of the fixed part 310 and the movable part 320 due to heat progresses, a melted part of the fixed part 310 and a melted part of the movable part 320 are separated by the insulation wall 333. Accordingly, it is possible to prevent an electric current from continuing to flow with the fixed part 310 and the movable part 320 being melted and sticking together.

Next, a method of connecting connectors according to this embodiment is described. Specifically, the transition from the state where the jack connector 100 and the plug connector 200 are separated to the state where the jack connector 100 and the plug connector 200 are mated to start supplying electric power and the transition from the state where electric power is supplied to the state where the supply of electric power is stopped are described in order.

Figure 11:
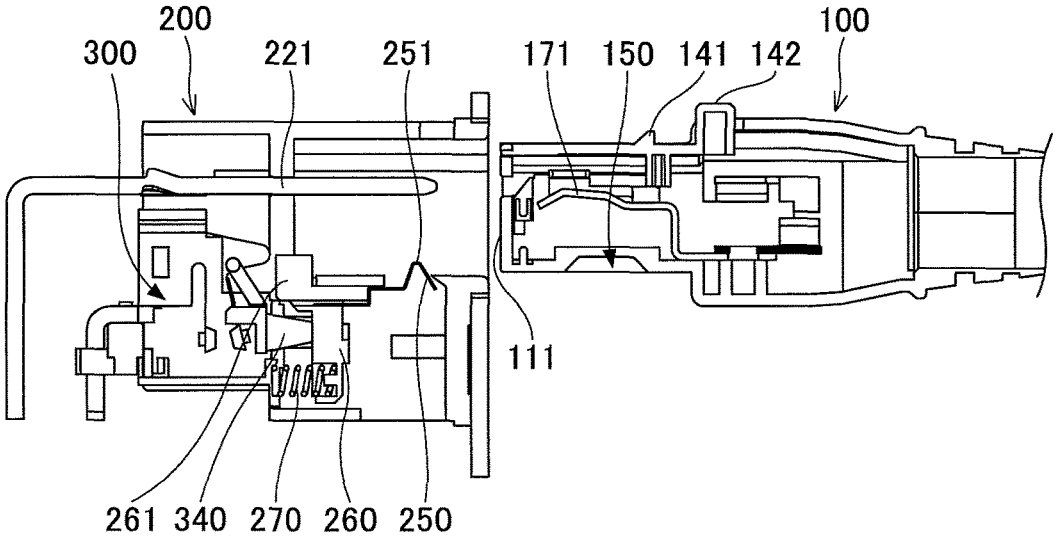
FIG. 11 is a diagram illustrating a process of connecting the jack connector and the plug connector according to the embodiment.
Figure 12:
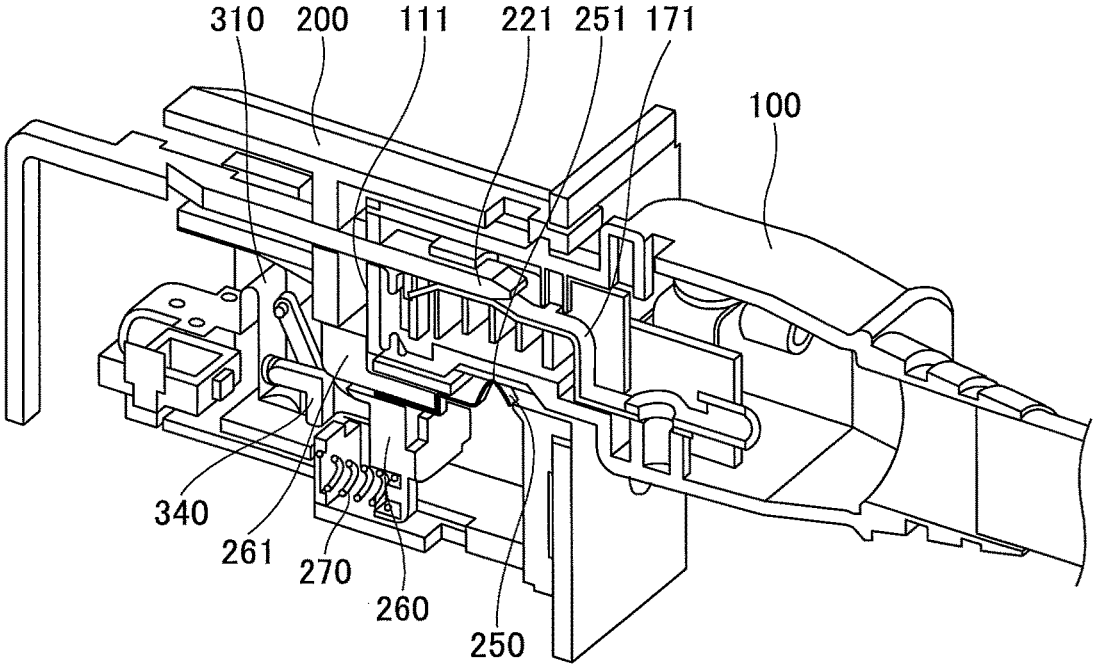
FIG. 12 is a diagram illustrating the process of connecting the jack connector and the plug connector according to the embodiment.

First, the jack connector 100 and the plug connector 200 are separated as depicted in FIG. 11. Then, as depicted in FIG. 12, the jack connector 100 is inserted into the plug connector opening 211 of the plug connector 200. As a result, the plug terminal 221 contacts a jack terminal 171 through the jack opening 121. Likewise, the plug terminal 222 contacts a jack terminal through the jack opening 122, and the plug terminal 223 contacts a jack terminal through the jack opening 123. In the above-described state as depicted in FIG. 12, the switch 300 is not turned on. Accordingly, no electric current is supplied to the jack connector 100.

In the state as depicted in FIG. 12, the contact movable part 261 is in contact with the contact surface 111. When the jack connector 100 is further pressed into the plug connector 200 in this state, the contact movable part 261 is pressed by the contact surface 111 to move the button 260 leftward in FIG. 12 against the urging force of the return spring 270.

Figure 13:
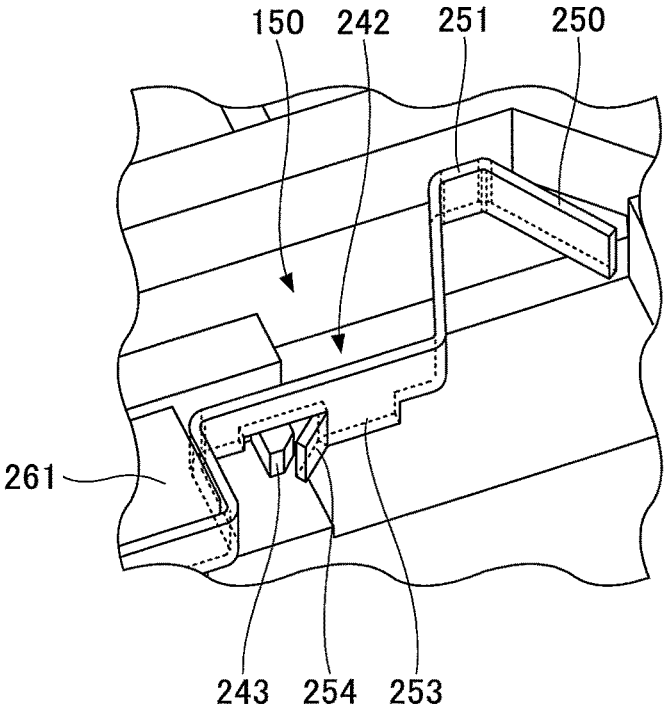
FIG. 13 is a diagram illustrating the process of connecting the jack connector and the plug connector according to the embodiment.

FIG. 13 is a diagram illustrating the position of the unlocking spring 250 in the state depicted in FIG. 12. As depicted in FIG. 13, the projection 251 of the unlocking spring 250 is in the unlocking groove 150 of the jack connector 100. The locking part 253 and the slope 254 of the unlocking spring 250 are positioned closer to the entrance of the plug connector opening 211 than a projection 243, which is provided deeper in the plug connector 200 than the spring opening 242.

Figure 14:
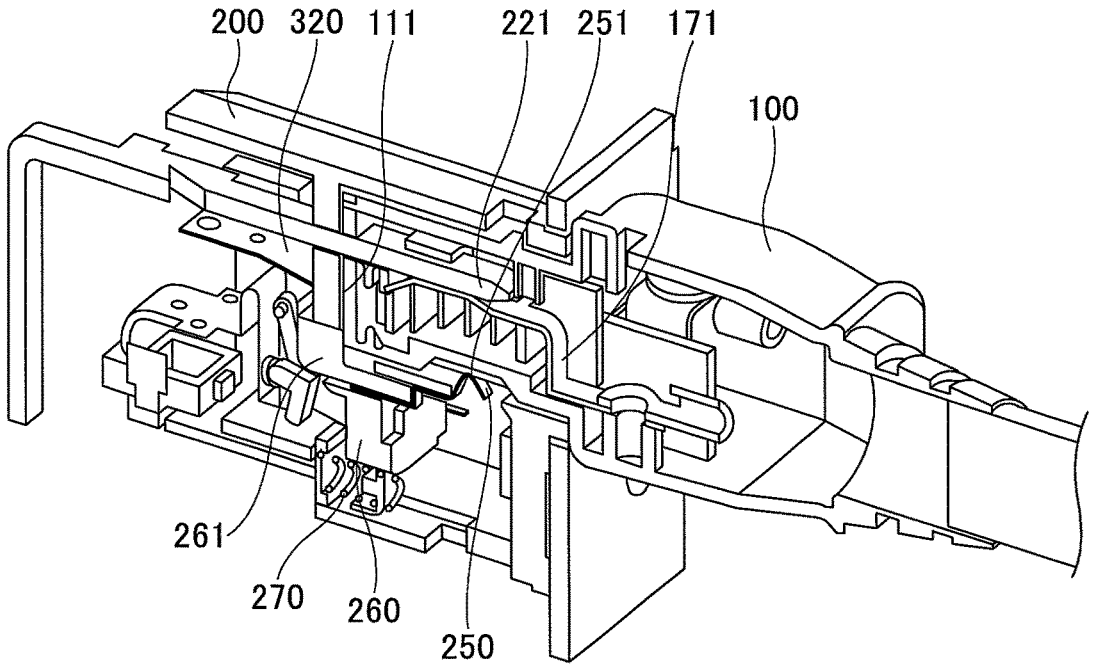
FIG. 14 is a diagram illustrating the process of connecting the jack connector and the plug connector according to the embodiment.

Next, as depicted in FIG. 14, the jack connector 100 is pressed further into the plug connector opening 211 from the position depicted in FIG. 12. As a result, the contact surface 111 presses the contact movable part 261 of the button 260 to move the button 260 further into the plug connector 200. As a result, the card 340 of the switch 300 is pressed by the button 260, so that the switch 300 turns on to supply electric current to the jack connector 100.

Figure 15:
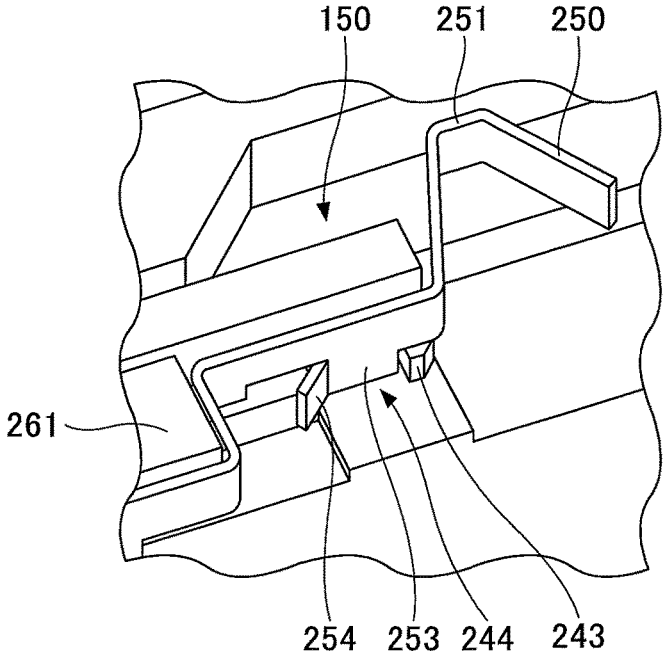
FIG. 15 is a diagram illustrating the process of connecting the jack connector and the plug connector according to the embodiment.
Figure 16:
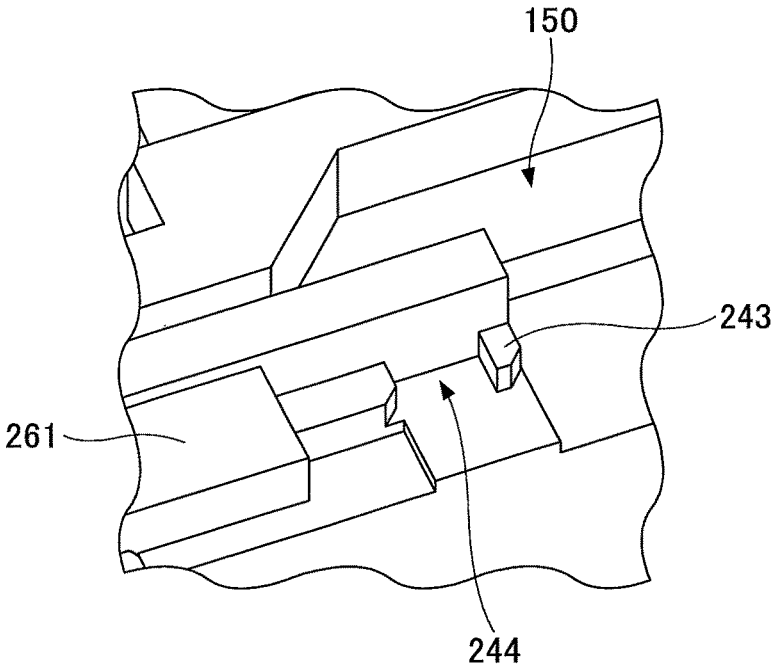
FIG. 16 is a diagram illustrating the process of connecting the jack connector and the plug connector according to the embodiment.
Figure 17:
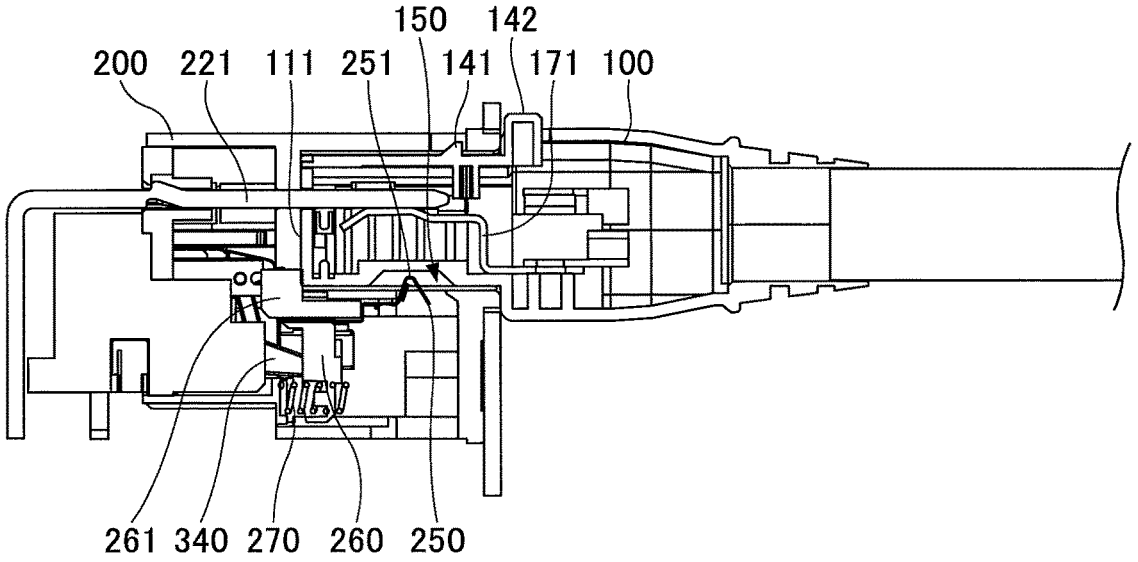
FIG. 17 is a cross-sectional view of the connected jack connector and plug connector according to the embodiment.
Figure 18:
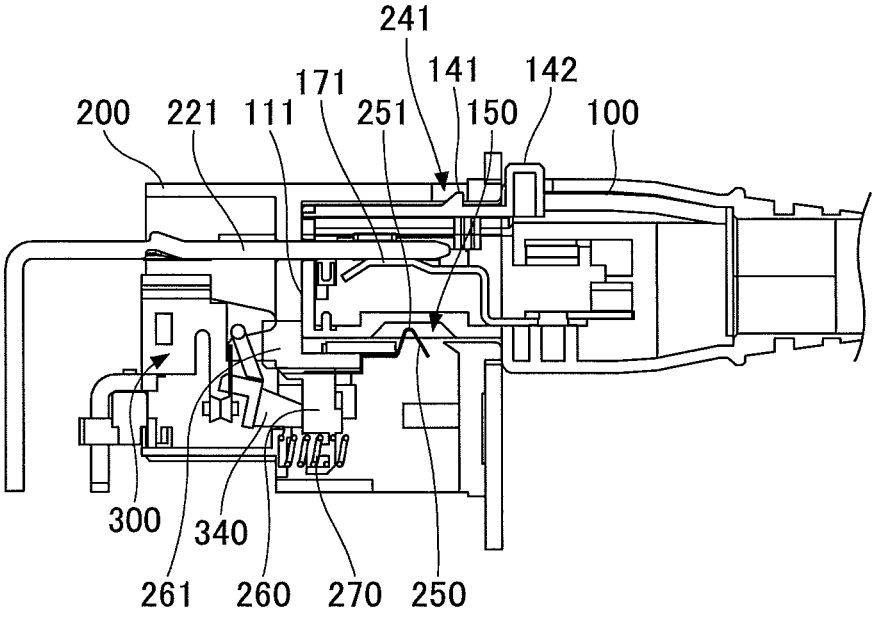
FIG. 18 is a cross-sectional view of the jack connector and the plug connector in a connected state according to the embodiment.
Figure 19:
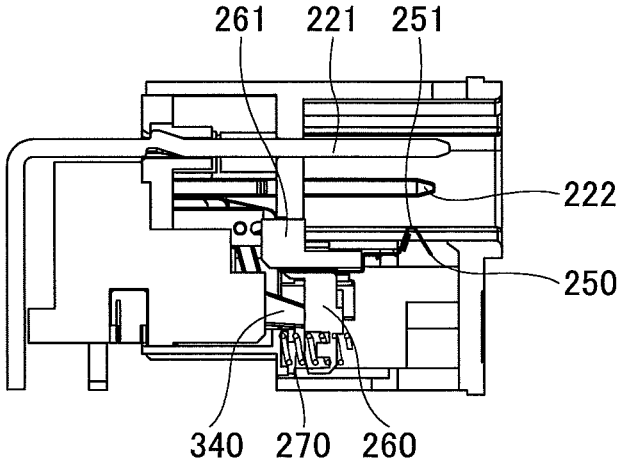
FIG. 19 is a cross-sectional view of the plug connector in the connected state according to the embodiment.
Figure 20:
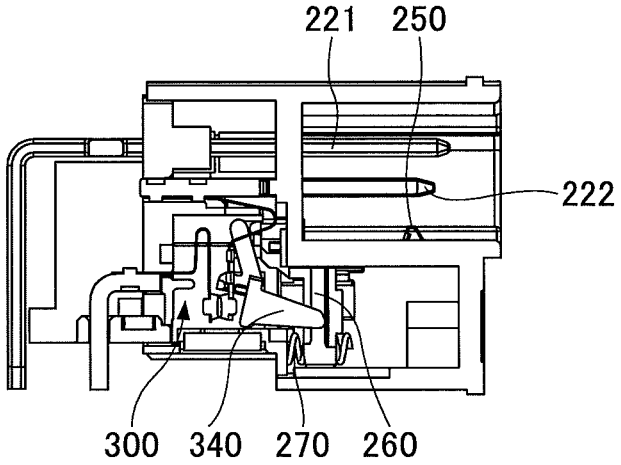
FIG. 20 is a cross-sectional view of the plug connector in the connected state according to the embodiment.
Figure 21:
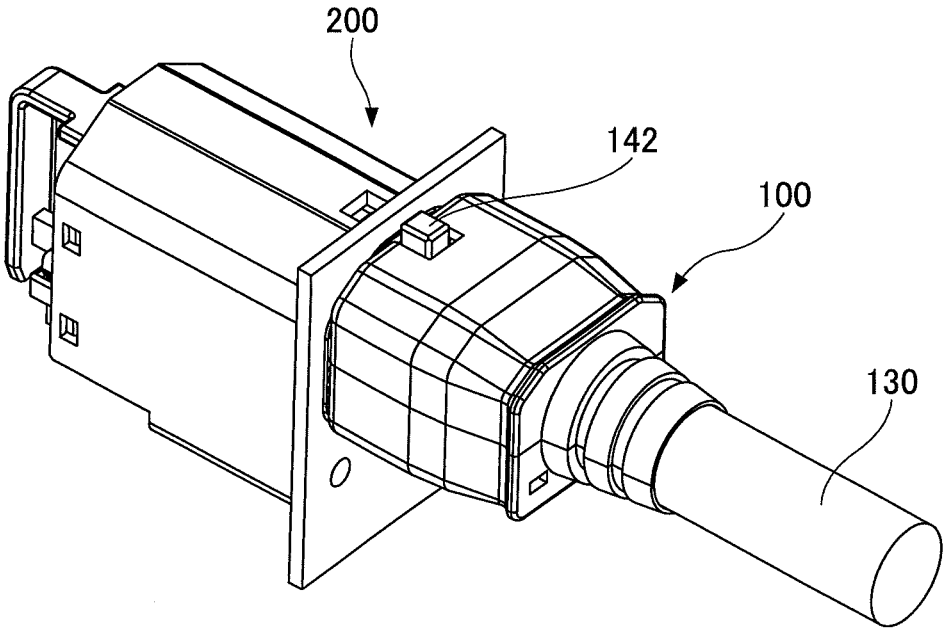
FIG. 21 is a perspective view of the jack connector and the plug connector in the connected state according to the embodiment.

Thus, as the button 260 moves deeper into the plug connector 200 from the position depicted in FIG. 12 to the position depicted in FIG. 14, the unlocking spring 250 also moves deeper into the plug connector 200 as depicted in FIG. 15. The locking part 253 and the slope 254 of the unlocking spring 250 move beyond the projection 243, and the locking part 253 moves into and is fixed to a recess 244, which is provided beyond the projection 243 to serve as an engaging part as depicted in FIG. 16. At this point, when the jack connector 100 is pushed in from the position as depicted in FIGS. 12 and 13, the slope 254 of the unlocking spring 250 contacts the projection 243 to depress the locking part 253. When the jack connector 100 is further pushed in, so that the locking part 253 passes the projection 243, the locking part 253 returns to its original position to enter the recess 244. As a result of the locking part 253 thus entering the recess 244, the right end of the locking part 253 contacts the left surface of the projection 243 in FIG. 15, so that the projection 243 prevents the unlocking spring 250 and the button 260 from moving toward the entrance side. As a result, the switch 300 is kept in the ON state, so that electric power is kept supplied. FIG. 15 is a diagram illustrating the position of the unlocking spring 250 in the state of FIG. 14. FIG. 16 is a diagram depicting the structure of FIG. 15 from which the unlocking spring 250 is removed. FIGS. 17 and 18 are cross-sectional views of the jack connector 100 and the plug connector 200 in the state of FIG. 14, taken at different cross sections. FIGS. 19 and 20 are cross-sectional views of the plug connector 200 in the state of FIG. 14, taken at different cross sections. FIG. 21 is a perspective view of the jack connector 100 and the plug connector 200 in the state of FIG. 14.

In particular, as is seen from FIGS. 18 and 20, an end of the card 340 of the switch 300 is pressed leftward in the drawings by the button 260, so that the card 340 pivots about the shaft 343 to press the movable plate 322. As a result, the movable contact 321 comes into contact with the fixed contact 311.

Figure 22:
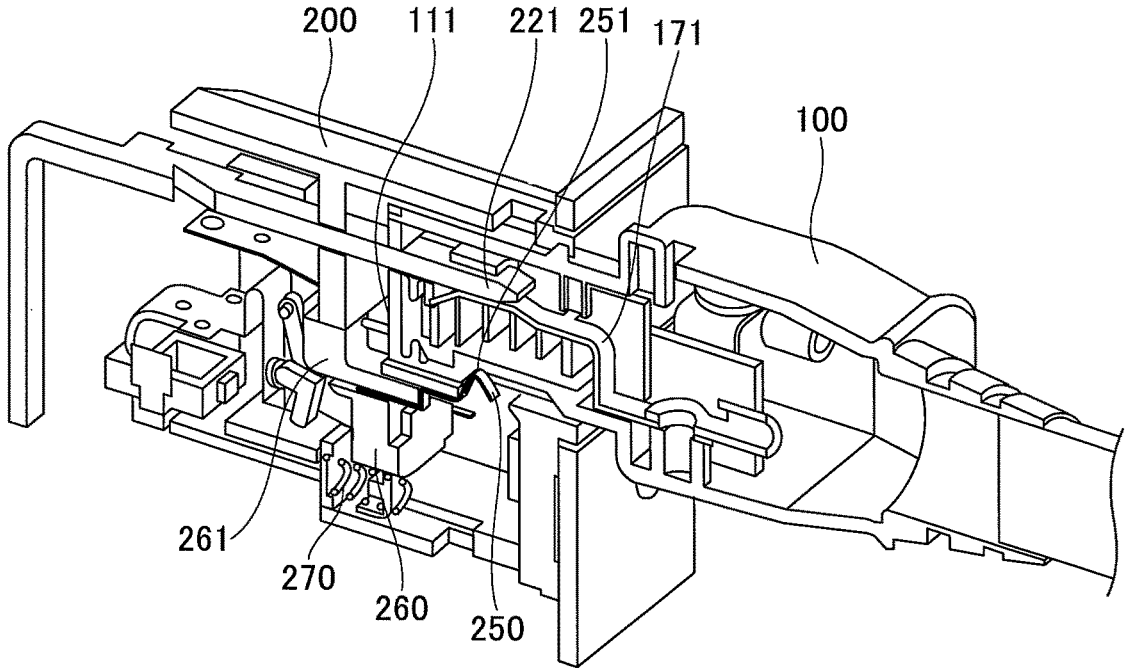
FIG. 22 is a diagram illustrating a process of disconnecting the jack connector and the plug connector according to the embodiment.
Figure 23:
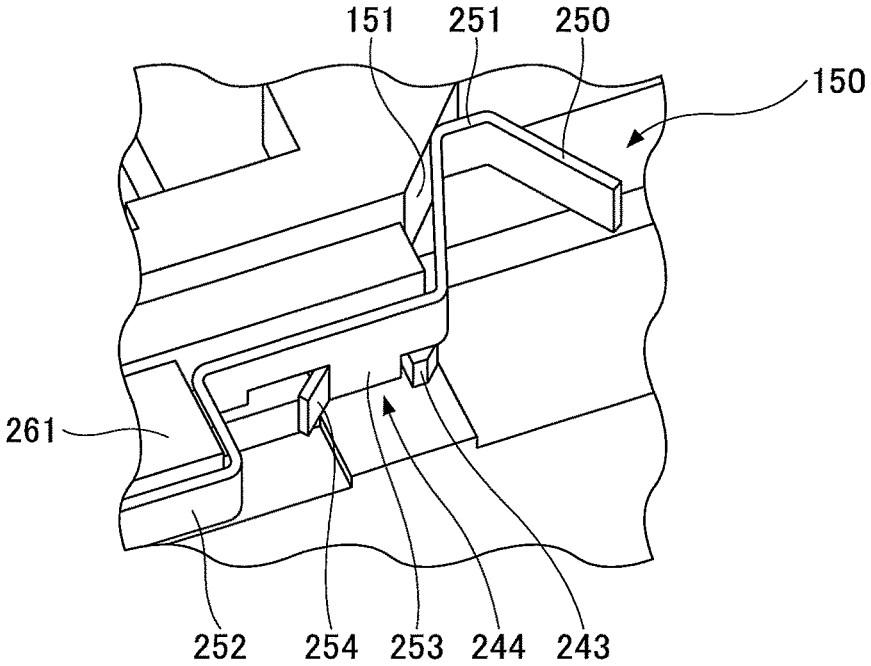
FIG. 23 is a diagram illustrating the process of disconnecting the jack connector and the plug connector according to the embodiment.

Next, the case of pulling the jack connector 100 off of the plug connector 200 is described. FIG. 22 is a diagram depicting the state where the jack connector 100 is slightly pulled off of the plug connector 200 by depressing the depressing part 142 to disengage the projection 141 and the opening 241, compared with the state as depicted in, for example, FIG. 14. In the state of FIG. 22, the button 260 is still pushed in. Therefore, the switch 300 is in the ON state with the plug terminals 221 through 223 contacting the corresponding jack terminals. Therefore, the supply of electric power continues in the state of FIG. 22. FIG. 23 is a diagram illustrating the position of the unlocking spring 250 in the state of FIG. 22. The locking part 253 is in the recess 244 and is kept fixed by the projection 243. As a result, the card 340 is kept pressed by the button 260, so that the switch 300 continues to be ON.

Figure 24:
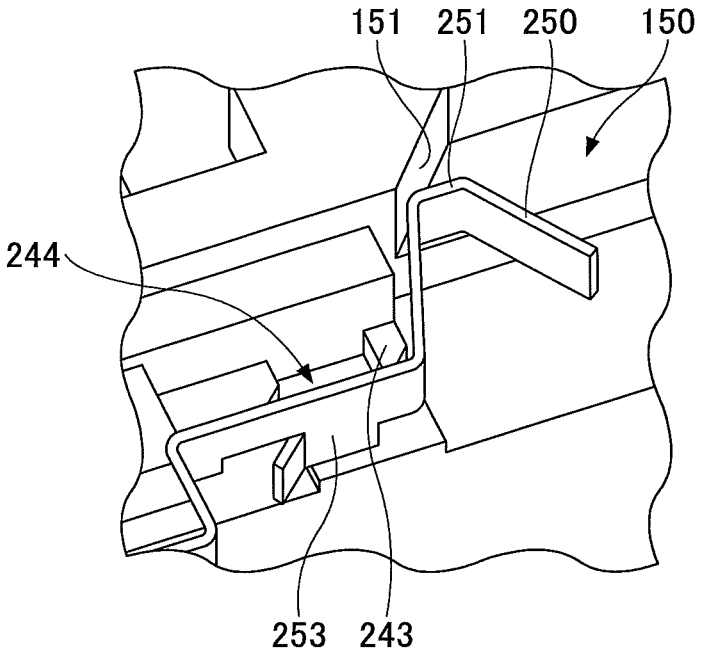
FIG. 24 is a diagram illustrating the process of disconnecting the jack connector and the plug connector according to the embodiment.

Thereafter, the jack connector 100 is further pulled off of the plug connector 200. As a result, as depicted in FIG. 24, the projection 251 of the unlocking spring 250 contacts the slope 151 at the end of the unlocking groove 150 to be pressed downward along the slope 151. As a result, the locking part 253 of the unlocking spring 250 is disengaged from the projection 243 to be removed from the recess 244. Accordingly, the restoring force of the return spring 270 returns the button 260 toward the front side of the plug connector 200, and as the button 260 returns, the unlocking spring 250 also returns to its original position (the position depicted in FIGS. 11 through 13). As a result of the button 260 and the unlocking spring 250 thus returning to their original positions with the restoring force of the return spring 270, the card 340 also returns to its original position to turn off the switch 300. Accordingly, the supply of electric power is interrupted. At this point, the button 260 instantaneously returns to its original position with the urging force of the return spring 270. Accordingly, the card 340 as well instantaneously returns to its original position. As a result, the movable contact 321 and the fixed contact 311 of the switch 300 immediately separate from each other to turn off the switch 300. The switch 300 turns off before the plug terminals 221 through 223 and the corresponding jack terminals are disconnected. In other words, the plug terminals 221 through 223 and the corresponding jack terminals are disconnected after the switch 300 turns off to be non-conducting.

According to this embodiment, it is possible to instantaneously turn off the switch 300 with the restoring force of the return spring 270 when interrupting the supply of electric power. Therefore, it is possible to minimize the generation of arcs.

Thereafter, by further pulling the jack connector 100 off of the plug connector 200, the jack connector 100 and the plug connector 200 are separated from each other as depicted in FIG. 11.

All examples and conditional language provided herein are intended for pedagogical purposes of aiding the reader in understanding the invention and the concepts contributed by the inventors to further the art, and are not to be construed as limitations to such specifically recited examples and conditions, nor does the organization of such examples in the specification relate to a showing of the superiority or inferiority of the invention. Although one or more embodiments of the present invention have been described in detail, it should be understood that the various changes, substitutions, and alterations could be made hereto without departing from the spirit and scope of the invention.

What is claimed is:

1. A connector connectable to another connector, comprising:

a switch, the switch including a fixed contact;

a movable contact provided at an end of a movable plate; and a card configured to move the movable plate;

a button configured to move the card;

a spring connected to the button, the spring including a locking part configured to engage with an engaging part formed in a housing of the connector; and a connection terminal connected to the switch, wherein the connection terminal is configured to connect to a connection terminal of said another connector when said another connector is inserted into the connector to a first position, the button is configured to be pressed by said another connector to move the card to close the switch to allow electric power to be supplied from the connector to said another connector, when said another connector is further inserted into the connector to a second position beyond the first position, the spring is configured to have the locking part entering and engaging with the engaging part when said another connector is inserted into the connector to the second position, and the spring is configured to have the locking part disengaging from the engaging part to open the switch with the connection terminal of the connector contacting the connection terminal of said another connector, to interrupt a supply of the electric power from the connector to said another connector, when said another connector is pulled off of the connector.

2. The connector as claimed in claim 1, wherein the switch is closed with the locking part being in and engaging with the engaging part.

3. The connector as claimed in claim 1, further comprising:

a return spring configured to urge the button in a direction to open the switch, wherein a restoring force of the return spring returns the button to an original position thereof when the locking part of the spring is disengaged from the engaging part.

4. The connector as claimed in claim 1, wherein the spring further includes a projection, and when said another connector is pulled off of the connector, the projection is pressed by a slope at an end of an unlocking part of said another connector to disengage the locking part of the spring from the engaging part.

5. The connector as claimed in claim 1, wherein the button includes a movable part configured to be pressed and moved by a contact surface of said another connector to move the card to close the switch.

6. A connector assembly, comprising:

the connector as set forth in claim 1; and said another connector.

* * * * *